US009251640B2

(12) United States Patent
Walsh et al.

(10) Patent No.: US 9,251,640 B2
(45) Date of Patent: Feb. 2, 2016

(54) HORIZONTAL LID DISPENSER

(71) Applicant: Kennik Innovations, LLC, Fort Dodge, IA (US)

(72) Inventors: Kenneth T. Walsh, Fort Dodge, IA (US); Nicholas Walsh, St. Charles, IA (US)

(73) Assignee: Bruegmann USA, Inc., Houston, TX (US)

( * ) Notice: Subject to any disclaimer, the term of this patent is extended or adjusted under 35 U.S.C. 154(b) by 155 days.

(21) Appl. No.: 14/085,710

(22) Filed: Nov. 20, 2013

(65) Prior Publication Data

US 2014/0175115 A1 Jun. 26, 2014

Related U.S. Application Data

(60) Provisional application No. 61/728,533, filed on Nov. 20, 2012.

(51) Int. Cl.
*G07F 11/24* (2006.01)
*G07F 11/00* (2006.01)

(52) U.S. Cl.
CPC ..... *G07F 11/24* (2013.01); *G07F 11/005* (2013.01)

(58) Field of Classification Search
None
See application file for complete search history.

(56) References Cited

U.S. PATENT DOCUMENTS

| | | | |
|---|---|---|---|
| 480,018 | A | 8/1892 | Hunter |
| 1,260,432 | A | 3/1918 | Nias |
| 1,272,701 | A | 7/1918 | Nias |
| 1,311,170 | A | 7/1919 | Lockwood et al. |
| 1,666,008 | A | 4/1928 | Graffenberger |
| 1,761,009 | A | 6/1930 | De Vries |
| 2,704,629 | A | 3/1955 | Andre et al. |
| 3,040,494 | A | 6/1962 | Anderson |
| 3,556,344 | A | 1/1971 | Lane et al. |
| 3,702,103 | A | 11/1972 | Price et al. |

(Continued)

FOREIGN PATENT DOCUMENTS

| | | |
|---|---|---|
| EP | 2415371 B1 | 3/2013 |
| FR | 1463166 | 6/1966 |

OTHER PUBLICATIONS

Logicor, "Reduce Waste and Increase Customer Confidence/SA With the Touch of a Button!", http://www.logicoriic.com/HTML/Redilid.html, Apr. 19, 2005, 1 page.

(Continued)

*Primary Examiner* — Leslie A Nicholson, III
*Assistant Examiner* — Ayodeji Ojofeitimi
(74) *Attorney, Agent, or Firm* — Richard A. Fagin

(57) ABSTRACT

A disk-shaped object dispenser includes a trough disposed in a substantially horizontal orientation for holding disk-shaped objects face to face. A guide is disposed at one end of the objects and movably engaged to the trough to urge the objects toward a dispending end. The guide is urged by a biasing device. A dispensing blade is disposed at an end of the trough and is movable transversely to a direction of the trough. The dispensing blade holds the disk-shaped objects in place when in a rest position and separates a forwardmost one of the objects when moved while retaining in place a remainder of the objects. A separator is operatively coupled with the dispensing blade and having a device to rotate fingers on lateral ends thereof. The fingers engage a bottom of the object separated by the blade to urge the separated object away from the dispensing blade.

11 Claims, 9 Drawing Sheets

(56) References Cited

U.S. PATENT DOCUMENTS

| | | | |
|---|---|---|---|
| 3,768,694 | A | 10/1973 | Miller |
| 3,795,344 | A | 3/1974 | Falk et al. |
| 4,319,441 | A | 3/1982 | Credle |
| 4,742,937 | A | 5/1988 | Blom |
| 4,881,660 | A | 11/1989 | Suttles |
| 4,897,019 | A | 1/1990 | Lemaire et al. |
| 4,949,526 | A | 8/1990 | Brogna et al. |
| 5,012,952 | A | 5/1991 | Franz |
| 5,038,969 | A | 8/1991 | Berger |
| 5,131,562 | A | 7/1992 | Brown |
| 5,328,052 | A | 7/1994 | Kizilos |
| 5,383,571 | A | 1/1995 | Gunderson |
| 5,513,096 | A | 4/1996 | Casler, Jr. |
| 5,702,029 | A | 12/1997 | Yang |
| 5,819,982 | A | 10/1998 | Brown |
| 5,918,765 | A | 7/1999 | Blankenship et al. |
| 5,944,220 | A | 8/1999 | Garske |
| 5,960,989 | A | 10/1999 | Gunderson |
| 6,113,345 | A | 9/2000 | Ashby |
| 6,357,624 | B1 | 3/2002 | Brown |
| 6,474,503 | B2 | 11/2002 | Davis |
| 6,527,139 | B2 | 3/2003 | Seagle |
| 6,832,694 | B2 | 12/2004 | Goeking et al. |
| 6,832,698 | B1 | 12/2004 | Dybul |
| 7,337,919 | B2 | 3/2008 | Walsh et al. |
| 2001/0038017 | A1 | 11/2001 | Davis |
| 2005/0194397 | A1 | 9/2005 | Hecht |
| 2005/0247724 | A1 | 11/2005 | Gapp |

OTHER PUBLICATIONS

Acry Fab:Innovative Food and Accessory Display Products, LidSaver, http://acryfab.com/al.php, Apr. 19, 2005, 2 pages.

International Search Report and Written Opinion, International Application No. PCT/US2006/014569.

HORIZONTAL LID DISPENSER

CROSS-REFERENCE TO RELATED APPLICATIONS

Priority is claimed under 35 U.S.C. §119 to U.S. Provisional Application No. 61/728,533 filed Nov. 20, 2012, herein incorporated by reference in its entirety.

STATEMENT REGARDING FEDERALLY SPONSORED RESEARCH OR DEVELOPMENT

Not applicable.

BACKGROUND

This disclosure relates generally to the field of disk dispensing devices. More specifically, this disclosure relates to a beverage lid dispenser When a beverage is purchased from a customer or user operating dispensing device, e.g. at a convenience store or restaurant, the beverage is dispensed into a cup or similar container inserted into the dispensing device either automatically or by the user. It is also common to obtain and secure a lid to the top of the container to prevent the contents from spilling. It is common for the user to obtain a lid from a stack of lids placed near the beverage dispenser. A drawback to such simple procedure is that when picking up the lid one may accidentally pick up several lids at the same time. This may lead to some of the lids being wasted. Another issue is that as users pick up more than one lid the users touch the other lids in the stack and consequently may contaminate some of the other lids in the stack.

U.S. Pat. No. 7,337,919 issued to Walsh et al. discloses a lid dispenser that uses a blade like mechanism movably in a direction transverse to a stack of lids to separate a single lid from the bottom of the bottom of the stack and move it outwardly for retrieval by the user.

SUMMARY

A disk-shaped object dispenser according to one aspect includes a trough disposed in a substantially horizontal orientation for holding disk-shaped objects face to face. A guide is disposed at one end of the objects and movably engaged to the trough to urge the objects toward a dispending end. The guide is urged by a biasing device. A dispensing blade is disposed at an end of the trough and is movable transversely to a direction of the trough. The dispensing blade holds the disk-shaped objects in place when in a rest position and separates a forwardmost one of the objects when moved while retaining in place a remainder of the objects. A separator is operatively coupled with the dispensing blade and having a device to rotate fingers on lateral ends thereof. The fingers engage a bottom of the object separated by the blade to urge the separated object away from the dispensing blade.

Other aspects and advantages will be apparent from the description and claims that follow.

DETAILED DESCRIPTION

A dispenser according to the present disclosure may be used for dispensing any disk-shaped object where the disk-shaped objects to be dispensed may or may not contain an outer rim. However, for the sake of simplicity, the present disclosure will be shown and described as a beverage container lid dispenser which dispenses a disk-shaped beverage container (e.g., disposable cup) lid. Preferably, a dispenser according to the present disclosure has an open-top trough or channel to hold a stack of beverage container lids ("lids"). The trough or channel may be V-shaped or any functionally similar shape having a distance between side walls that increases with respect to distance from a bottom of the trough so that beverage container lids of any diameter can contact the two sides of the trough. Such contact may help to hold and guide the stack of lids. The trough may have telescoping drawer slides enabling the beverage lid dispenser to be mounted to an exposed bottom surface of a counter top and pulled outwardly from the mounting position for refilling the trough with lids. The present dispenser differs from a vertically oriented lid dispenser which uses gravity to feed lids into a dispensing blade. In such vertical dispensers, gravity will cause the remaining lids in the stack to move toward the dispenser blade each time a lid is dispensed. In the present example, a biasing device such as a spring loaded trolley may be used to urge the stack of lids toward the dispending blade.

Figure 1:
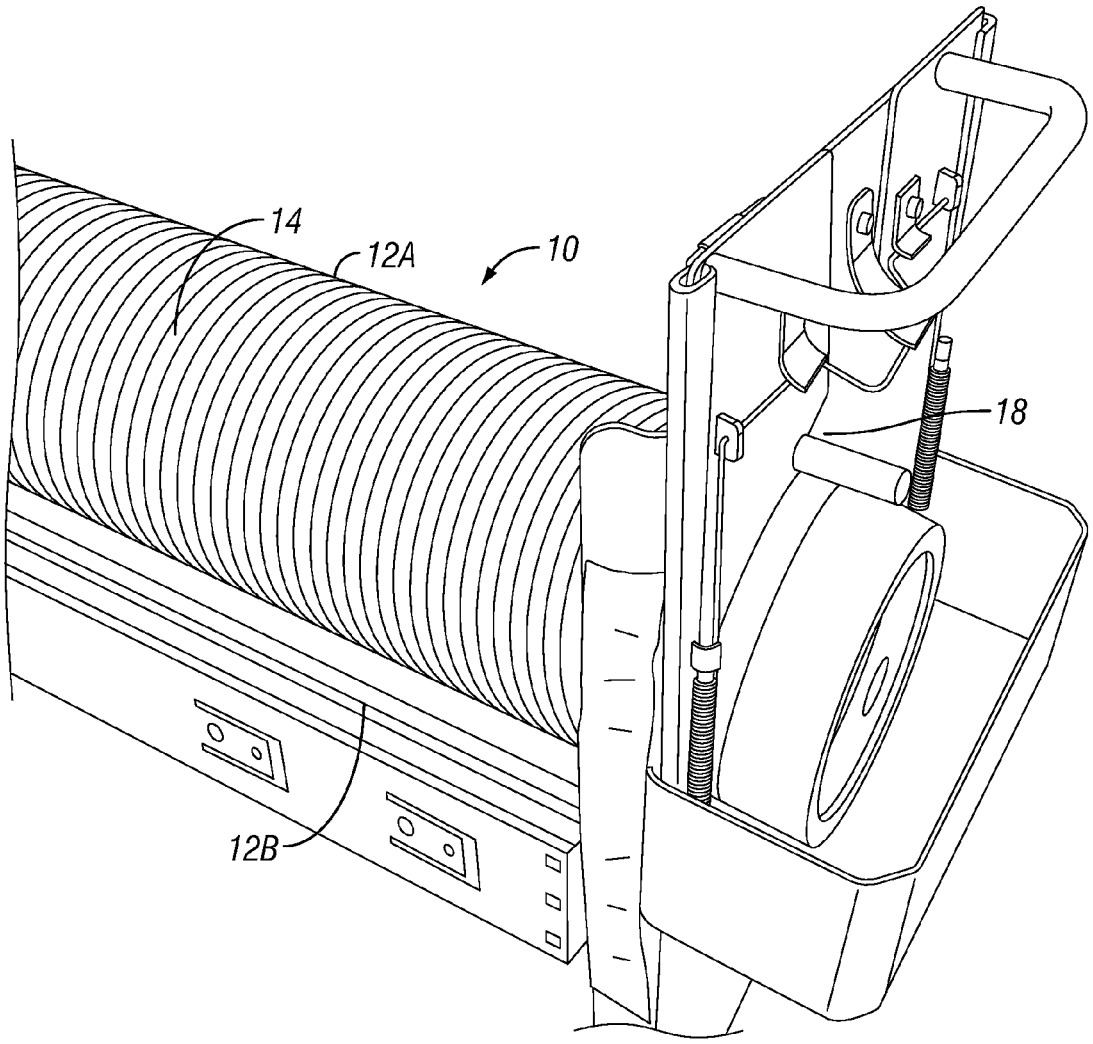
FIGS. 1 to 3 show various views of a stack of beverage container lids in an example dispenser according to the present disclosure.
Figure 2:
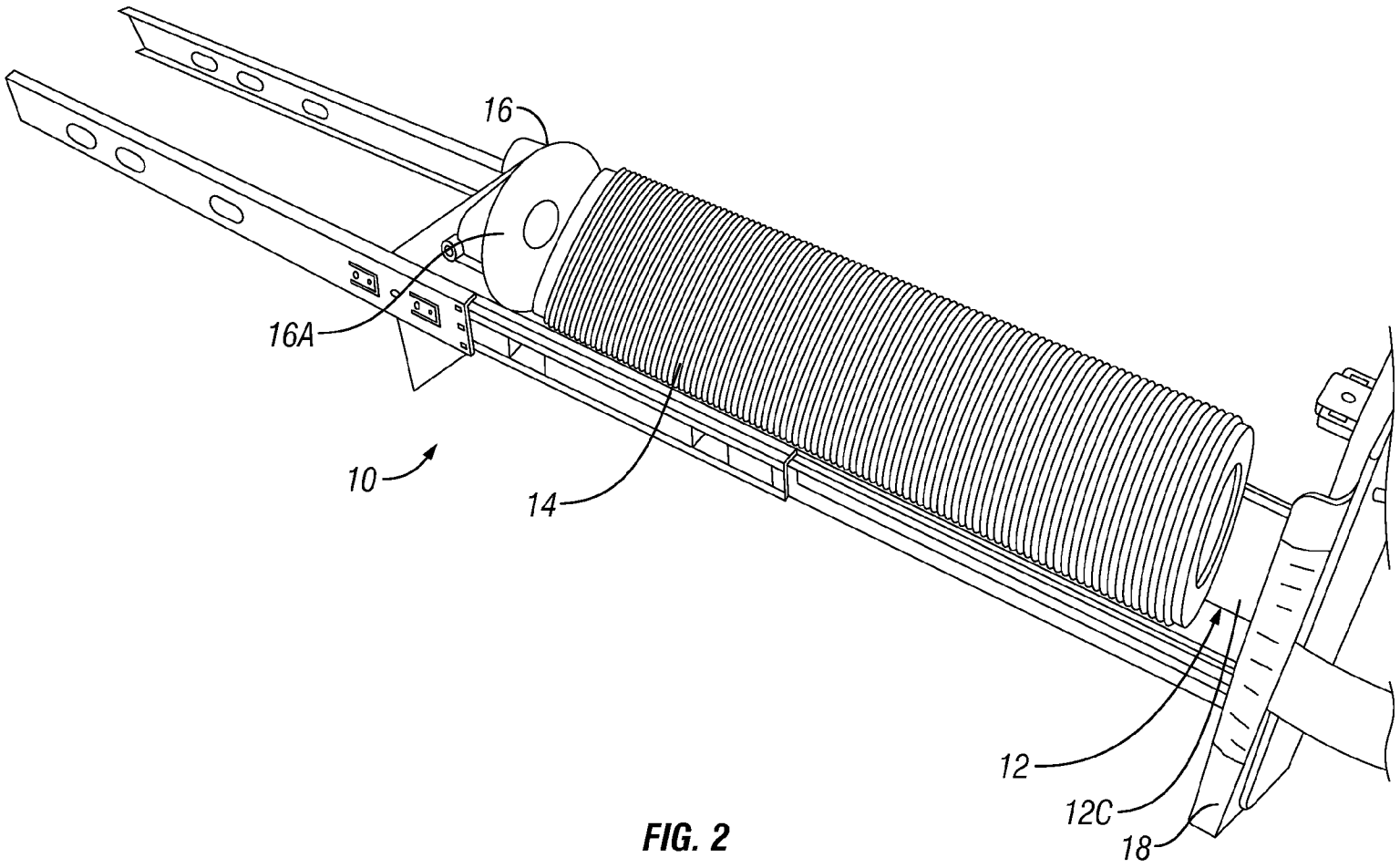
Figure 3:
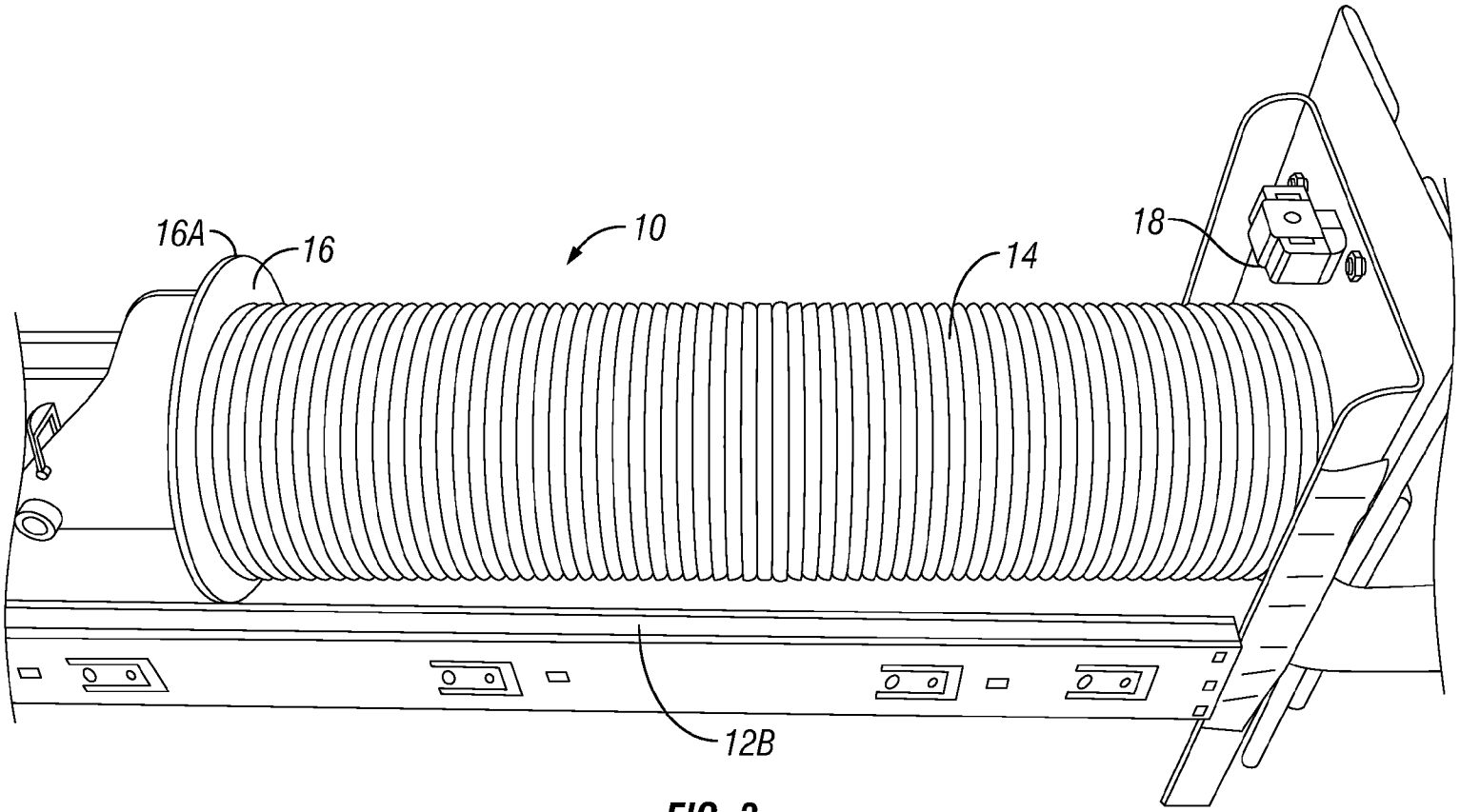

As shown in FIGS. 1-3, the lid dispenser 10 may include an area to support the lids, such as a trough, shown exposed at 12 in FIG. 2. The trough (12 in FIG. 2) can be of any shape suitable to holding lids, e.g., stack 14, but may preferably be V-shaped to accommodate a variety of lid sizes. The V shape may be obtained by disposing converging side walls (12A, 12B in FIGS. 1 and 3) on opposite sides of the dispenser 10. Lids can be placed in the trough in a stack, as shown at 14. Preferably, the bottom of the V-shaped trough (12 in FIG. 2) has a narrow slot (12C in FIG. 2) that may extend substantially the entire length of the trough (12 in FIG. 2) to accommodate a moveable guide 16. The guide 16 applies pressure to one end of the stack 14 of lids to continually urge the lids toward a dispensing area 18. The guide 16 may be any device configured to move longitudinally along the trough 14. The present example, the guide 16 may be a "trolley" with a plate (16A in FIGS. 2 and 3) that pushes the stack of lids 14 toward a blade mechanism, further explained below, at a longitudinal end of the trough 14.

Figure 4:
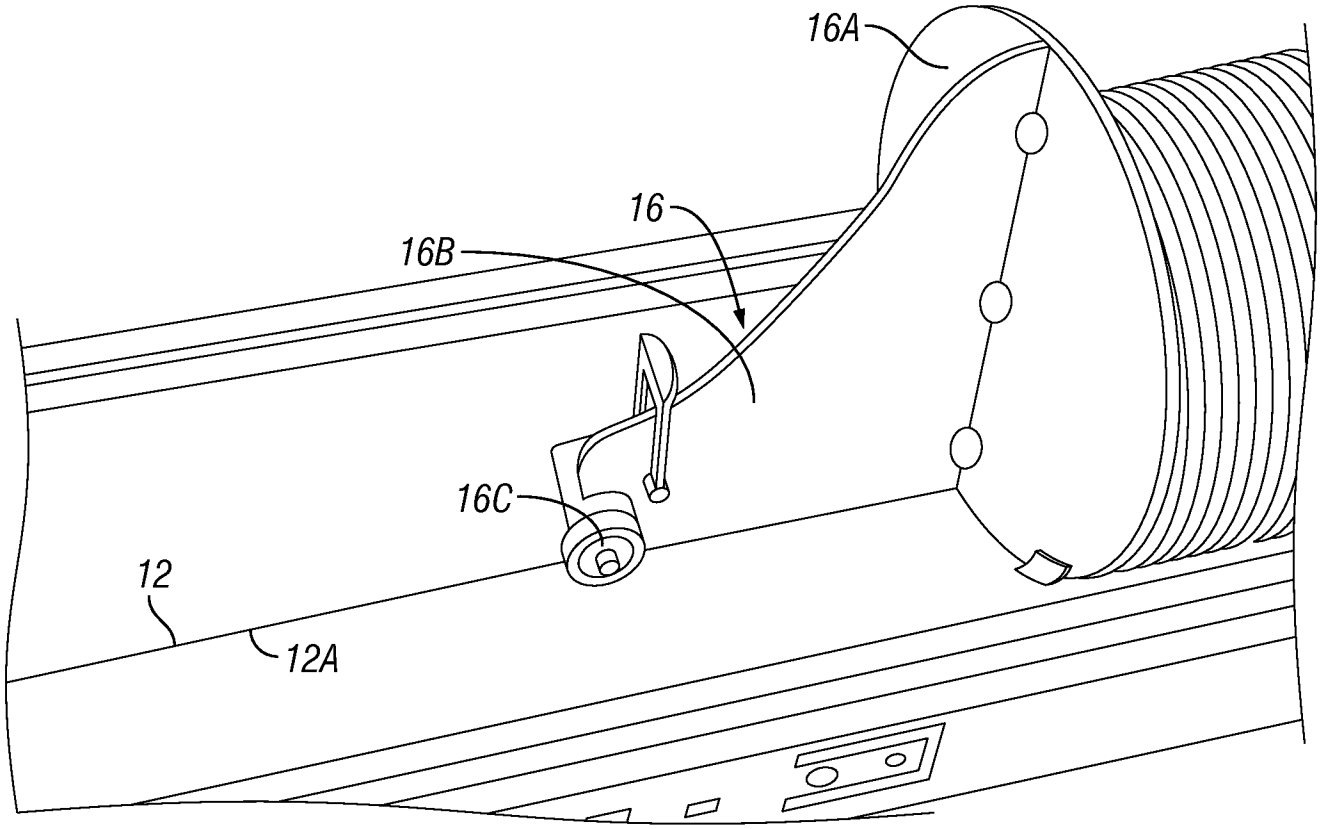
FIG. 4 shows an example guide to urge a stack of lids toward a dispenser portion of the dispenser.

An example embodiment of the guide 16 is shown in FIG. 4. Preferably, the plate 16A is made of metal, but any suitable material may be used. The plate 16A is generally transverse to the longitudinal dimension of the trough 12. The plate 16A may have affixed to a side thereof opposite to the stack (14 in FIG. 2) a plate guide and pusher 16B ("pusher"). The pusher 16B may be configured to slidingly engage the slot 12A and be coupled to a biasing device 16C to urge the plate 16A toward a dispensing end (18 in FIG. 3) of the trough 12.

To ensure the guide 16 is sturdy and easily moveable, rollers, wheels, or side blocks may be added. In the example embodiment shown in FIG. 4, the guide 16 may move along the slot 12A in the center of the tray on four rollers (not shown separately) two above and two below the trough 12 to keep the guide 16 in a vertical orientation as it travels along the slot 12. The guide 16 in the present example may include a biasing device to urge the guide 16 toward the dispending area to apply pressure on the stack of lids 14 and push the lids toward the dispensing area as shown at 18 in FIG. 5.

Figure 6:
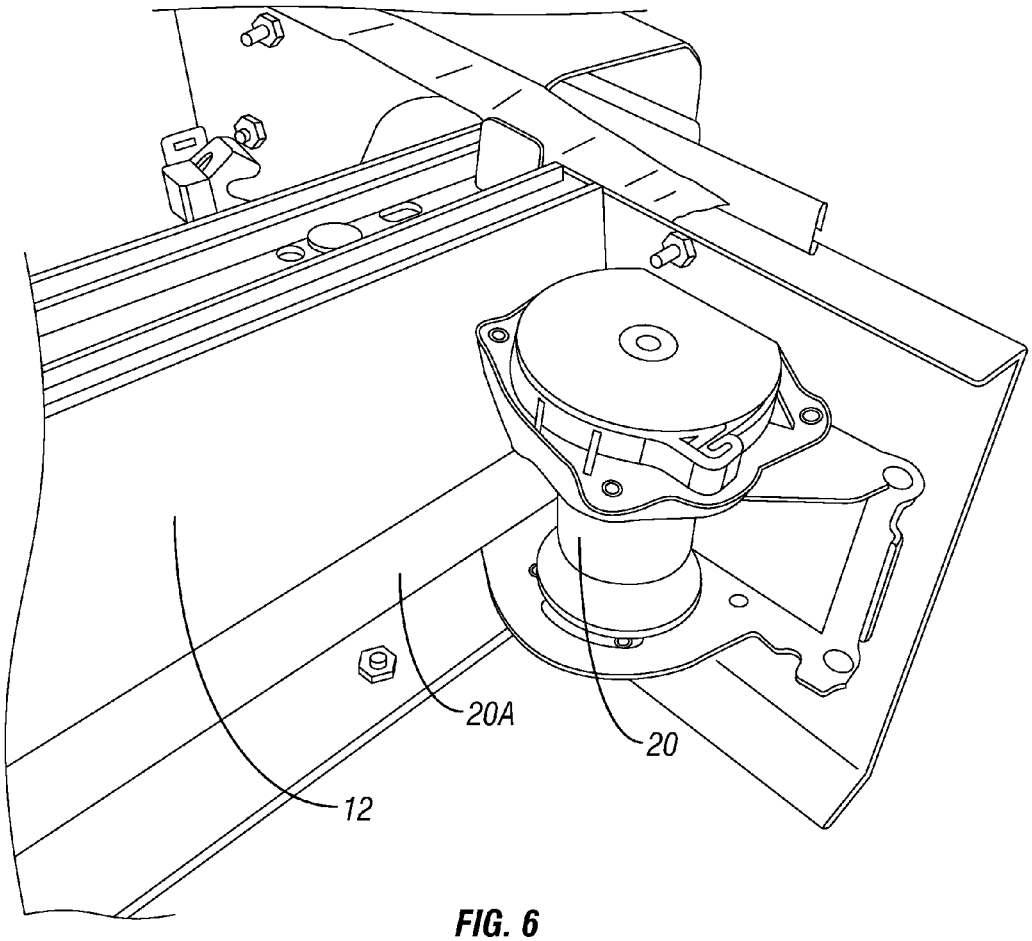
FIG. 6 shows an example spring loaded spool or reel to pull on a guide as shown in FIG. 4.
Figure 7:
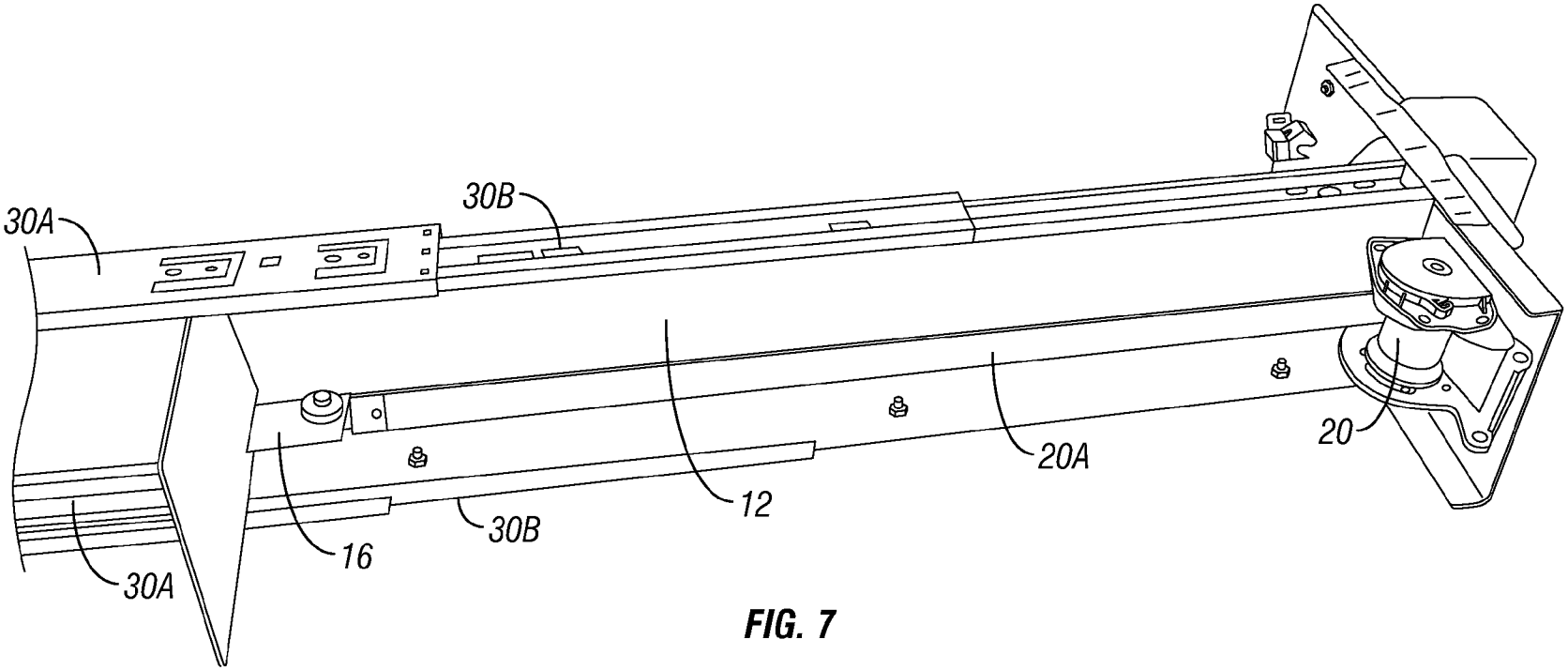
FIG. 7 show a strap spooled by the reel in FIG. 6 as well as telescoping cabinet guides.
Figure 8:
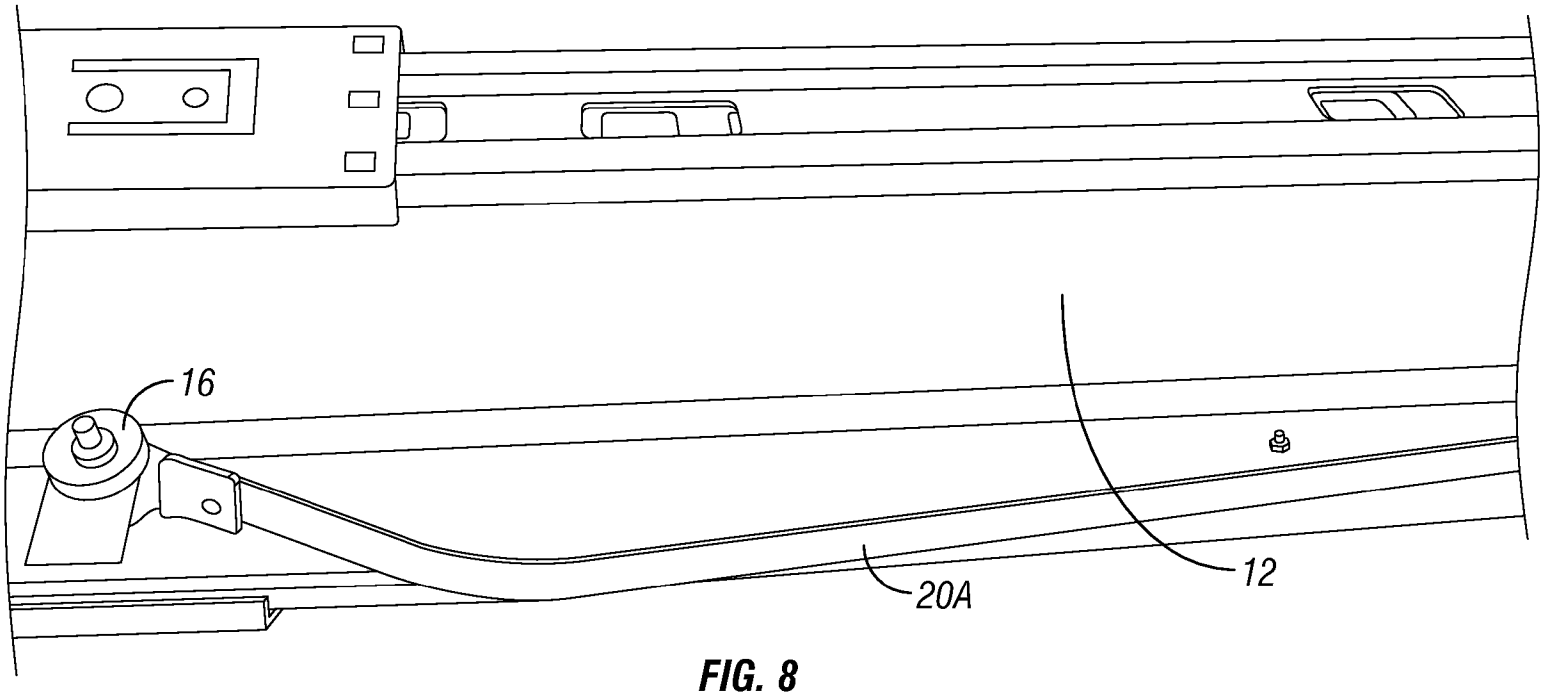
FIG. 8 shows the strap of FIG. 7 connected to the guide of FIG. 4.

This forward pressure or force can be generated by any suitable biasing device. For example, one or more springs held in compression can be placed behind the guide 16 opposite the stack of lids 14. Alternatively, one or more springs can be operatively secured to the lid side of the guide 16 or plate 16A and held in tension to pull the guide 16 toward the dispensing area (18 in FIG. 5). An example biasing device will be explained with reference to FIGS. 6-8. Force on the guide 16 in the direction of the dispensing end (18 in FIG. 5) of the trough (12 in FIG. 4) may be provided by a spring loaded reel 20 mounted to the forward underside of the trough 12 behind the dispensing end (18 in FIG. 5). The reel 20 may be spring loaded to pull on a flexible strap 20A to apply tension on the guide (16 in FIG. 4) toward the dispensing end (18 in FIG. 5). The strap 20A may be made from flexible metal, cloth, flexible plastic or any durable, flexible (i.e., spoolable) material that can reliably withstand the tension load applied by the reel 20.

Figure 9:
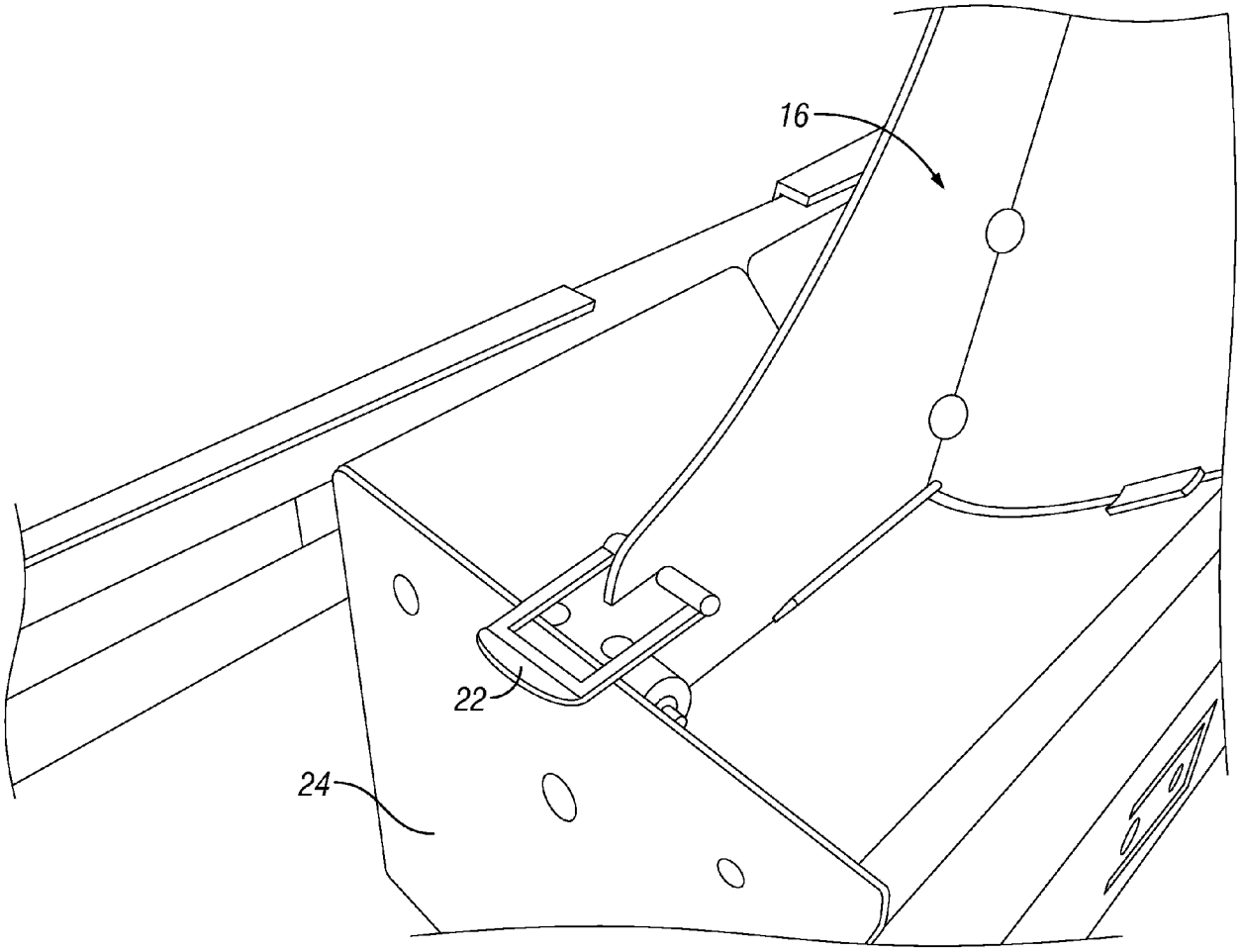
FIG. 9 shows a back end of the guide of FIG. 4 wherein a tab may be used to hold the guide in a retracted position for loading the dispenser.

FIG. 9 shows a back end of the guide 16. The guide may include a hook or tab 22 secured to the rear of the guide 16 (away from the stack of lids). The area containing the lids, such as the trough (12 in FIG. 4), also may includes a rear wall 24 or other device that the tab or hook 22 can engage when the guide 16 is fully retracted (i.e., moved fully away from the dispensing area). In the present embodiment, the dispenser 10 may be filled or refilled with lids (14 in FIGS. 1-3) by pulling the guide 16 to the rear of the trough (12 in FIG. 2) and securing the tab or hook 22 to the rear wall 24 of the trough 12. While the tab or hook 22 can be made of any durable material, in the present example the tab or hook 22 may be made of metal. After inserting lids into the trough and releasing the tab 22 from the back wall 24, the reel (20 in FIG. 6) pulls the guide (16 in FIG. 4) toward the dispensing end (18 in FIG. 5) to engage the stack of lids (14 in FIGS. 1-3) and provide the required urging force on the lid stack.

In this present example, and referring once more to FIG. 5, the dispensing end may include a blade 18A positioned vertically with respect to the end of the trough and is visible at the front of the dispenser 10. The blade 18A may a handle, knob or similar holding device 18C attached to the top of the blade 18A so that when the blade 18A is pushed down by hand, the blade 18A separates one lid from the stack of lids (14 in FIGS. 1-3). Alternatively, a lever may be operatively secured to the blade 18A to ensure ease of operation.

Figure 5:
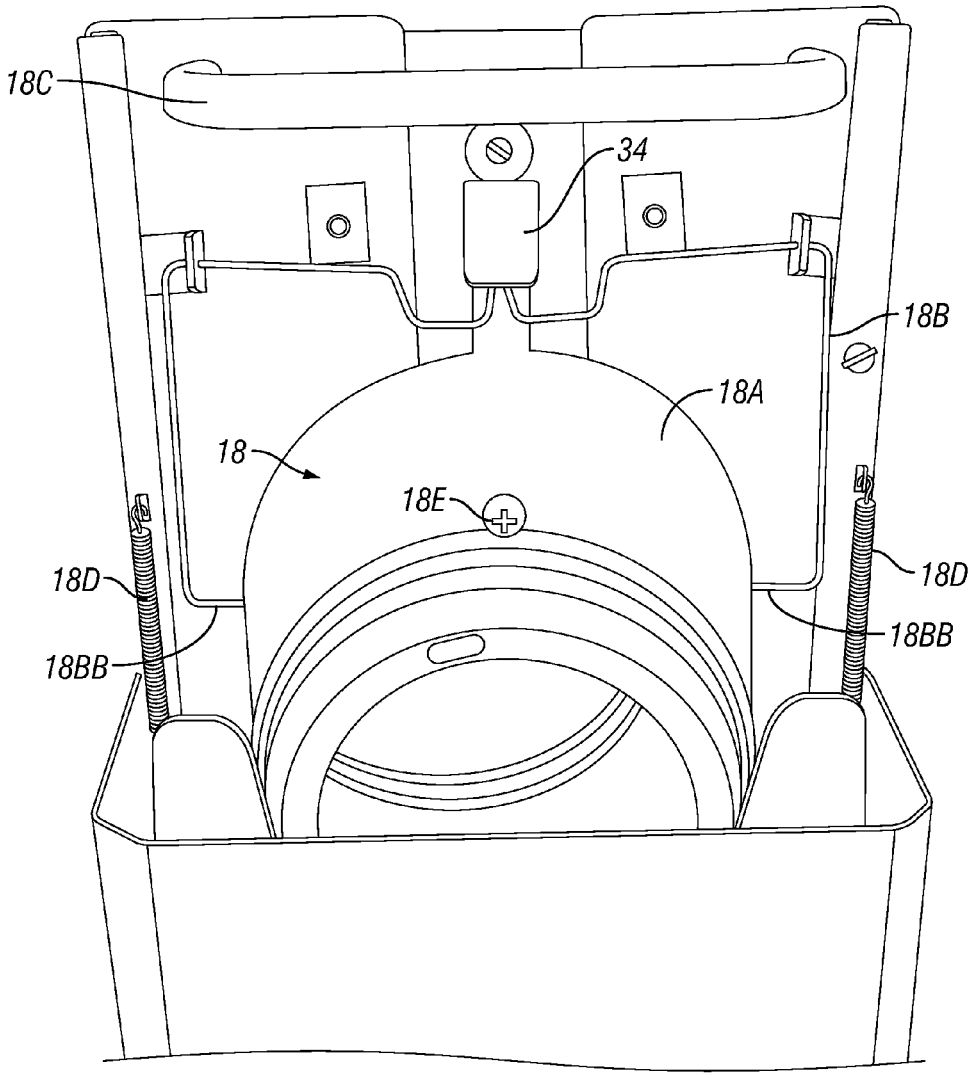
FIG. 5 shows an example dispensing end mechanism according to the present disclosure.

A device to urge a separated lid forward (hereinafter a "flicker") so that it can drop away from the remainder of the stack of lids as shown at 18B in FIG. 5 may be included on the dispensing side of the blade. The flicker 18B may be a spring-loaded wire mechanism incorporated onto the blade 18A to push the separated lid forward at the very end of the blade 18A stroke allowing the separated lid to drop away. The blade 18A may be urged back upwardly to a rest position by springs 18D. In the rest position, the blade holds 18A the lids (i.e., stack 14 in FIG. 2) behind the blade 18A in place at a base thereof. As the blade 18A is pushed downwardly by the operator, e.g., using handle 18C, the lower part of the blade 18A or base that the lids rest on begins to move downward. The base (not shown) may extends just past the center of the endmost lid when at rest. Above the base, a little more than the thickness of a lid, is a second portion of the blade 18A, which may include an elongate hole (not shown) that is larger on three side than the diameter of the of the lids. A fourth side of the hole is elongated the length of the stroke and opposite the direction of travel, and the opening is smaller than the lid diameter. As the blade 18A is activated or depressed, the blade base (not shown) begins to move away from the bottom lid and the smaller elongated portion of the upper blade enters just above the bottom lid and contains or holds the second lid in place. As the end of the travel is reached the base no longer supports the bottom of the first lid, allowing it to be released. The flicker 18B may be included into the blade edge to the right and left of the bottom of the first lid and between the bottom of second lid to push the bottom of the first lid away from the second lid, allowing it to drop. The foregoing is more fully described in U.S. Pat. No. 7,337,919 issued to Walsh et al., which patent is incorporated by reference in its entirety as if fully set forth herein.

The present example dispenser differs from the vertical design in the foregoing disclosed patent which uses gravity to feed lids into the blade. In a vertical dispenser, the lids fall off on their own each time the blade operating lever is depressed. In the present example horizontal version, dispensing a lid may need the inclusion of a removal system. Horizontal in the present context means that the orientation of the trough (12 in FIG. 2) is substantially transverse to vertical, or at angles having insufficient vertical component to effectively use gravity as a force to urge the lids (e.g., stack 14 in FIG. 2) to the dispensing end of the dispenser. There are many removal systems that can be used. However, as shown in FIG. 5, an example removal system may include the flicker 18B to accomplish dispensing of the lids. As the blade 18A is actuated, the wire flicker 18B will actuate at the very end of the stroke and push the front lid forward allowing it to drop. The flicker 18B device is actuated by applying downward pressure on the blade 18A. This causes the flicker 18B to travel downwardly with the blade 18A until the flicker 18B makes contact with a stationary stop bar 18E. The stop bar 18E prevents further downward travel of the central portion of the flicker 18B. The flicker 18B is rotationally secured to the blade 18A. 18B Thus, additional downward force causes the flicker 18B to begin to rotate away from the blade 18A, thus pushing two opposed flicker arms out and away from the blade 18B. The arms each include a finger 18BB at the ends thereof which travel behind the lid being dispensed during the downward motion of the blade 18A. During rotational motion, the finger 18BB contacts the back of the lid and causes it to be ejected away from the remaining lids in the stack (14 in FIGS. 1-3). Once ejected, the lid may fall into a forward portion of the dispenser for retrieval.

After the lid has been dispensed, the blade 18A is returned to its original position by the springs 18D. Similarly, a spring, such as a flexible metal strip 34 shown in FIG. 5 which is located above the flicker's 18B center portion, pushes the flicker 18B and fingers 18BB back into their respective rest positions.

Referring once again to FIG. 7, one or more telescoping cabinet drawer slides 30A, 30B may be operatively secured to the each side of the dispenser. In this manner, the dispenser may be mounted into a cabinet and simply pulled out, like a drawer, for easy loading of lids. Additionally, a clasp (not shown) may be added to ensure the drawer remains closed when desired.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A disk-shaped object dispenser, comprising:

a trough disposed in a substantially horizontal orientation for holding a plurality of the disk-shaped objects face to face;

a guide disposed at one end of the plurality of disk-shaped objects and movably engaged to the trough to urge the objects toward a dispending end thereof, the guide urged by a biasing device;

a dispensing blade at an end of the trough and movable in a plane transverse to a direction of the trough, the dispensing blade configured to hold the disk-shaped objects in place when in a rest position, the dispensing blade configured to separate a forwardmost one of the plurality of disk-shaped objects when moved while retaining in place a remainder of the disk-shaped objects;

a separator operatively coupled with the dispensing blade, the separator having a device to rotate fingers on lateral ends thereof, the fingers engaging a bottom of the disk-shaped object separated by the blade to urge the separated object away from the dispensing blade; and a pusher engaged with the dispensing blade and configured to have fingers at lateral ends thereof rotated away from the dispensing blade when the dispensing blade is actuated, the fingers positioned proximate a bottom of the disk-shaped object separated by the blade when actuated to urge the separated object away from the dispensing blade.

2. The dispenser of claim 1 wherein the disk-shaped objects comprise beverage container lids.

3. The dispenser of claim 1 wherein the trough comprises side walls converging toward a bottom of the trough to accommodate varying sizes of disk-shaped objects.

4. The dispenser of claim 3 further comprising a channel in a center of the trough.

5. The dispenser of claim 4 wherein the guide is movably engaged with the trough.

6. The dispenser of claim 1 wherein the guide is coupled to a biasing device configured to urge the guide toward the dispensing blade.

7. The dispenser of claim 6 wherein the biasing device comprises a spring loaded reel having a flexible strap wound thereon disposed proximate the dispensing blade end of the trough, an end of the flexible strap functionally coupled to the guide.

8. The dispenser of claim 7 further comprising a means for releasably retaining the guide in a fully retracted position for refilling the trough with disk-shaped objects.

9. The dispenser of claim 1 wherein the dispensing blade is user operable by depressing a handle thereon, and is returned to a rest position by springs engaged to the dispensing blade.

10. The dispenser of claim 1 further comprising telescoping sliding mounts operable to enable the dispenser to be moved outward from a mounting and operating position for refilling the trough with disk-shaped objects.

11. The dispenser of claim 10 wherein the telescoping sliding mounts are configured to mount the dispenser under a counter surface.

* * * * *